US006686826B1

(12) United States Patent
Hsu

(10) Patent No.: US 6,686,826 B1
(45) Date of Patent: Feb. 3, 2004

(54) TRANSFORMER HAVING STABILIZED POWER OUTPUT

(76) Inventor: Nien Fu Hsu, 6F, No. 440-2, Gin Pin Road, Chong Ho City, Taipei Hsien (TW), 235

( * ) Notice: Subject to any disclaimer, the term of this patent is extended or adjusted under 35 U.S.C. 154(b) by 6 days.

(21) Appl. No.: 10/199,515

(22) Filed: Jul. 17, 2002

(51) Int. Cl.[7] ..... H01F 27/24
(52) U.S. Cl. ..... 336/234; 336/65; 336/212
(58) Field of Search ..... 336/234, 65, 67, 336/55, 60, 61, 212

(56) References Cited

U.S. PATENT DOCUMENTS

| | | | | |
|---|---|---|---|---|
| 4,149,135 A | | 4/1979 | Roespel et al. | 336/65 |
| 4,879,804 A | | 11/1989 | Chiang | 29/605 |
| 6,597,272 B1 | * | 7/2003 | Hsu | 336/234 |

FOREIGN PATENT DOCUMENTS

| | | | |
|---|---|---|---|
| JP | 62-37918 | * | 2/1987 |
| JP | 62-291108 | * | 12/1987 |
| JP | 3-62506 | * | 3/1991 |
| JP | 3-73504 | * | 3/1991 |
| JP | 3-248407 | * | 11/1991 |

* cited by examiner

*Primary Examiner*—Chau N. Nguyen

(57) ABSTRACT

A transformer includes a ferrite base plate having ferrite core between two grooves, two or more windings wound around the ferrite core and engaged in the grooves of the ferrite base plate and electrically coupled together and separated from each other, for forming two spaces in the grooves of the ferrite base plate and formed between the windings. One or more conductive panels may be engaged into each of the spaces of the ferrite base plate for reducing the voltage generated by the windings, and for supplying a stabilized electric power source to electric devices.

3 Claims, 4 Drawing Sheets

TRANSFORMER HAVING STABILIZED POWER OUTPUT

BACKGROUND OF THE INVENTION

1. Field of the Invention

The present invention relates to a starter or a transformer, and more particularly to a starter or a transformer for controlling or for energizing light devices.

2. Description of the Prior Art

Typical starters or transformers are provided for controlling or for energizing the light devices, and comprise a primary winding and a secondary winding engaged around a ferrite core each. U.S. Pat. No. 4,149,135 to Roespel et al., and U.S. Pat. No. 4,879,804 to Chiang disclose two of the typical starters or transformers.

When a high voltage electric power up to 1200 volts is required for energizing some kinds of electric facilities, for example, an addition set of starter or transformer is required and coupled to the starter or transformer, for increasing the voltage up to 1200 volts, and for energizing the light devices, for example.

However, such high voltage may normally provide an over load greater than the light devices may be suffered, such that the fuses for the electric facilities will be easily burned and are required to be replaced with the new ones frequently. In addition, a great cost is required for manufacturing such high voltage starter or transformer.

Furthermore, when such a high voltage may be generated, a great heat or temperature may also be generated relatively, and may also damage the starter or transformer frequently. In addition, much more load or power will be consumed due to the greater heat and high temperature.

The present invention has arisen to mitigate and/or obviate the afore-described disadvantages of the conventional starters or transformers.

SUMMARY OF THE INVENTION

The primary objective of the present invention is to provide a starter or a transformer for safely controlling or for energizing light devices.

The other objective of the present invention is to provide a starter or a transformer for providing a stabilized electric power output to energize the light devices.

In accordance with one aspect of the invention, there is provided a transformer for electric facilities, the transformer comprising a ferrite base plate including two grooves formed therein, for forming and defining a ferrite core between the grooves thereof, a first winding and at least one second winding engaged in the grooves of the ferrite base plate, and wound around the ferrite core, the first and the at least one second windings being electrically coupled together, and separated from each other, for forming two spaces in the grooves of the ferrite base plate respectively and formed between the first and the at least one second windings, and at least one conductive panel being engaged into each of the spaces of the ferrite base plate respectively.

The ferrite base plate may include a number of plates secured together. Two or more pairs of partitions may further be provided and engaged in the grooves of the ferrite base plate, and disposed on sides of the first and the at least one second windings respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
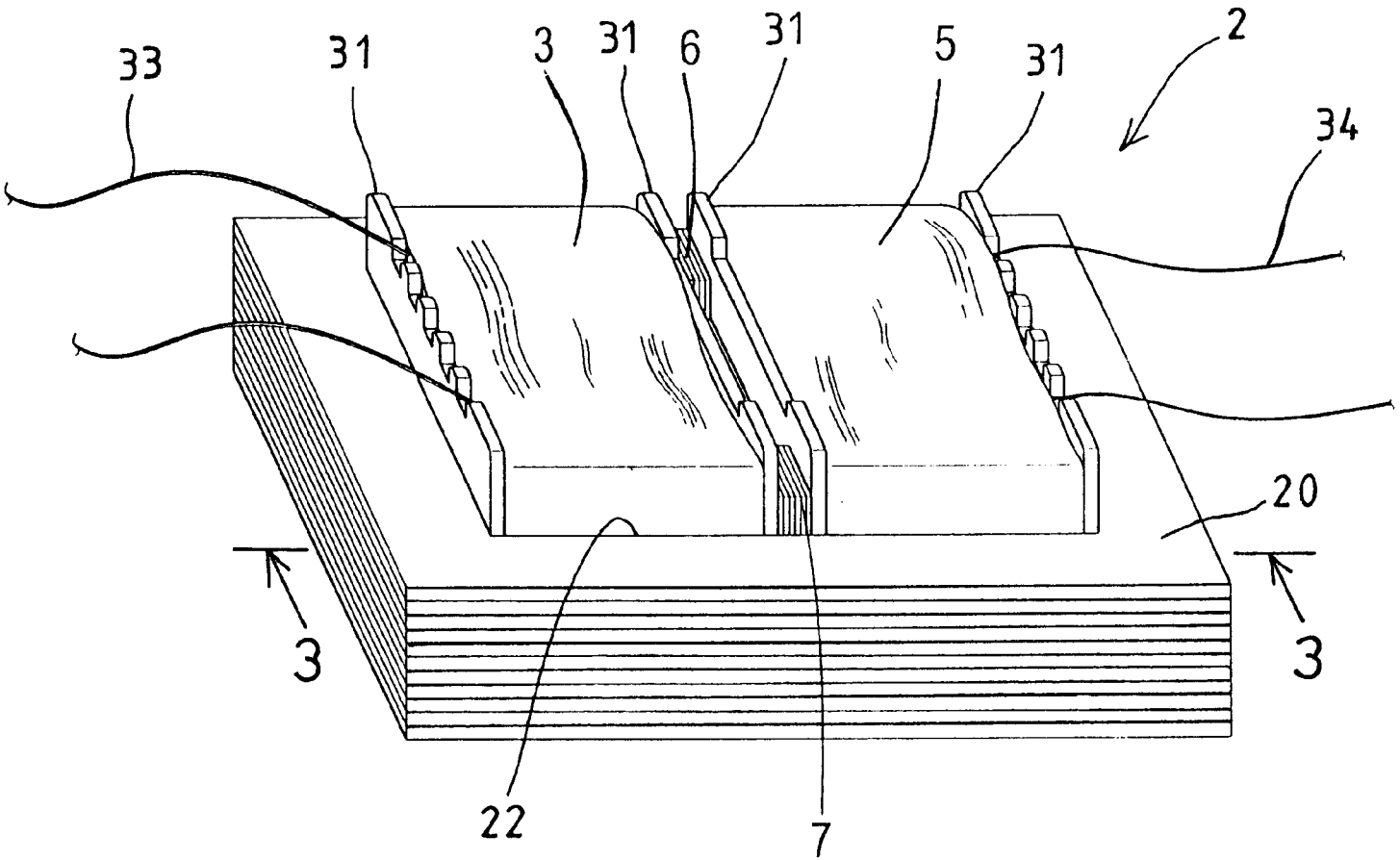
FIG. 1 is a perspective view of a starter or a transformer in accordance with the present invention.
Figure 2:
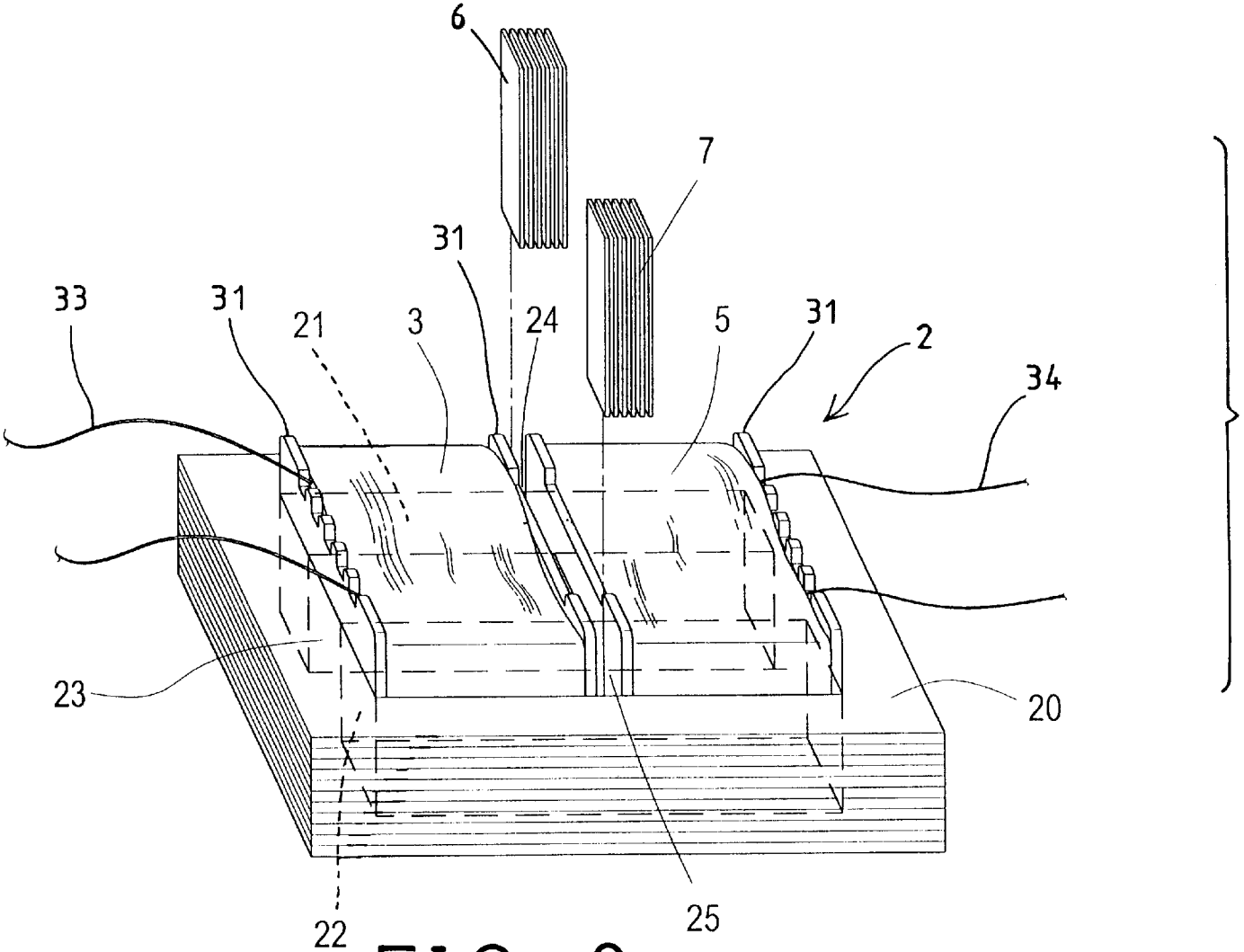
FIG. 2 is a partial exploded view of the starter or a transformer.
Figure 3:
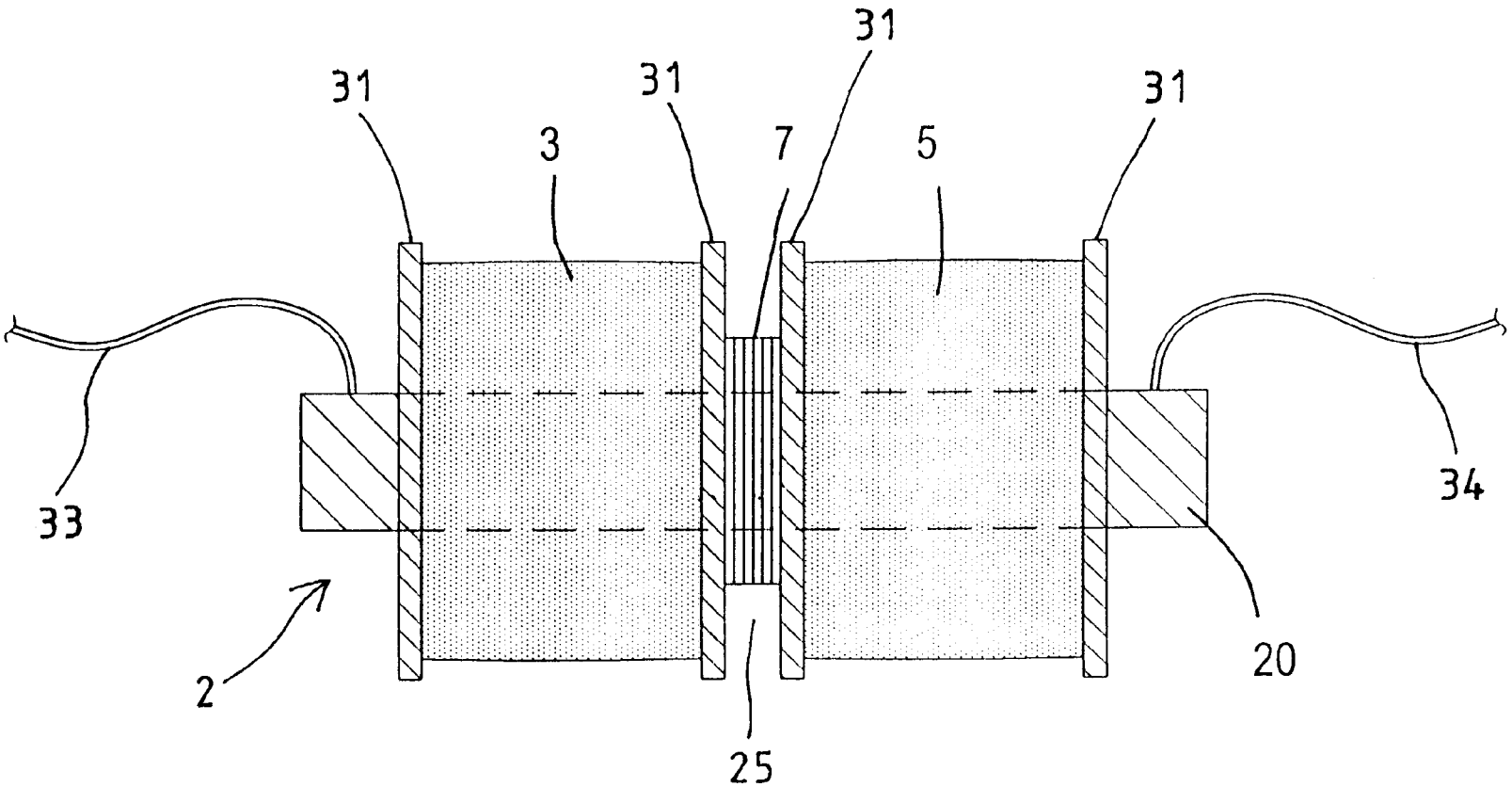
FIG. 3 is a partial cross sectional view taken along lines 3—3 of FIG. 1.

Referring to the drawings, and initially to FIGS. 1–3, a starter or a transformer in accordance with the present invention comprises a ferrite base plate 2 including two grooves 21, 22 formed therein, and preferably parallel to each other, for forming or defining a ferrite core 23 between the grooves 21, 22 thereof. The ferrite base plate 2 may include a one-integral piece 20 (FIG. 3), or may include one or more plates 20 secured together (FIGS. 1, 2, 4).

A first winding 3, and one or more further or second windings 5 are engaged in the grooves 21, 22 of the ferrite base plate 2, and wound around the ferrite core 23, for forming two coils (3, 5) in one ferrite base plate 2. Two or more pairs of partitions 31 are also engaged in the grooves 21, 22 of the ferrite base plate 2, and disposed on the sides of the windings 3, 5 respectively.

The windings 3, 5 are electrically coupled together, but separated from each other, such that two spaces 24, 25 may be formed in the grooves 21, 22 of the ferrite base plate 2 respectively and formed between the two windings 3, 5. One or more conductive panels 6, 7, such as steel panels 6, 7 may further be provided and engaged into the spaces 24, 25 of the ferrite base plate 2 respectively.

Figure 4:
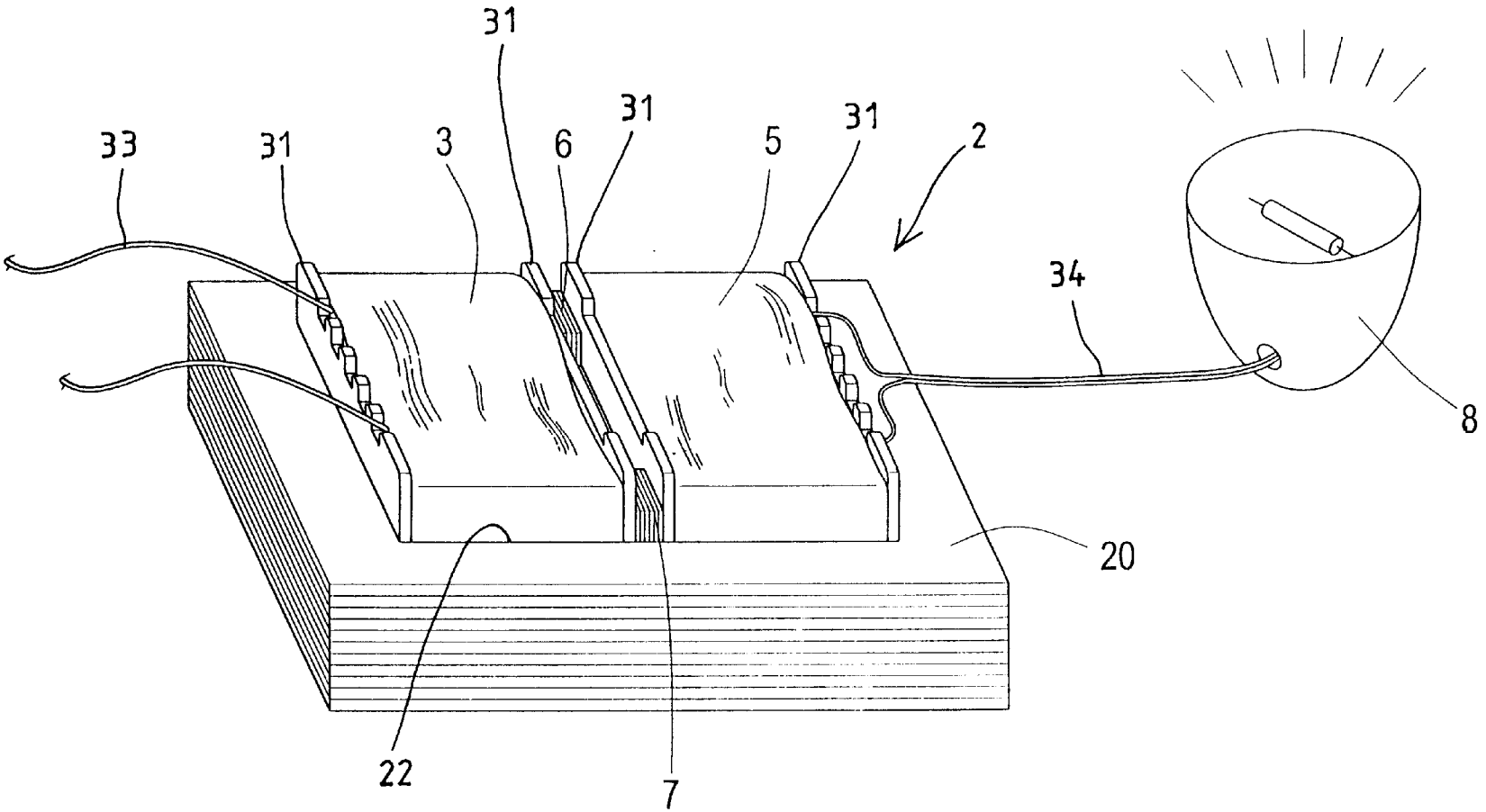
FIG. 4 is a perspective view illustrating the operation of the starter or the transformer for the light devices.

In operation, as shown in FIG. 4, the first winding 3 may be coupled to the electric power source with electric wires 33, for example. The other or the second winding 5 may be coupled to the electric facilities, such as the light device 8 with electric wires 34.

Once the windings 3, 5 are energized, a voltage more than 1200 volts may be generated by the windings 3, 5. However, the conductor panels 6, 7 may slightly lower and stabilize the voltage generated by the windings 3, 5, in order to provide a stabilized electric power to start or to energize the electric facilities, such as the light device 8.

Accordingly, the starter or the transformer in accordance with the present invention may be used for safely controlling or for energizing light devices and for providing a stabilized electric power output to energize the light devices or the other electric facilities.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A transformer for electric facilities, said transformer comprising:

a ferrite base plate including two grooves formed therein, for forming and defining a ferrite core between said grooves thereof, a first winding and at least one second winding engaged in said grooves of said ferrite base plate, and wound around said ferrite core, said first and said at least one second windings being electrically coupled together, and separated from each other, for forming two spaces in said grooves of said ferrite base plate respectively and formed between said first and said at least one second windings, and at least one conductive panel being engaged into each of said spaces of said ferrite base plate respectively.

2. The transformer according to claim 1, wherein said ferrite base plate includes a plurality of plates secured together.

3. The transformer according to claim 1 further comprising two pairs of partitions engaged in said grooves of said ferrite base plate, and disposed on sides of said first and said at least one second windings respectively.

* * * * *